US011466470B1

(12) United States Patent
Bramlett et al.

(10) Patent No.: US 11,466,470 B1
(45) Date of Patent: Oct. 11, 2022

(54) MULTI-LEVEL PARKING GARAGE FOR WRAP STYLE BUILDING

(71) Applicant: TQC Precast LLC, Fort Worth, TX (US)

(72) Inventors: William Bramlett, Fort Worth, TX (US); Jimmy Fagala, Fort Worth, TX (US)

(73) Assignee: TQC Precast LLC, Fort Worth, TX (US)

( * ) Notice: Subject to any disclaimer, the term of this patent is extended or adjusted under 35 U.S.C. 154(b) by 0 days.

(21) Appl. No.: 17/241,886

(22) Filed: Apr. 27, 2021

(51) Int. Cl.

| | |
|---|---|
| ***E04H 6/10*** | (2006.01) |
| ***E04B 1/20*** | (2006.01) |
| ***E04B 1/04*** | (2006.01) |
| ***E04B 1/94*** | (2006.01) |
| ***E04B 5/04*** | (2006.01) |

(52) U.S. Cl.
CPC ..... *E04H 6/10* (2013.01); *E04B 1/04* (2013.01); *E04B 1/20* (2013.01); *E04B 1/942* (2013.01); *E04B 5/04* (2013.01)

(58) Field of Classification Search
CPC ..... E04H 6/08; E04H 6/10; E04B 1/04; E04B 1/20; E04B 2/92; E04B 2/94; E04B 5/04
See application file for complete search history.

(56) References Cited

U.S. PATENT DOCUMENTS

| | | | | |
|---|---|---|---|---|
| 2,598,750 A | | 6/1952 | Bargehr | |
| 3,302,339 A | | 2/1967 | White | |
| 3,495,371 A | * | 2/1970 | Mitchell, Jr. | E04B 1/215 52/653.1 |
| 3,739,540 A | | 6/1973 | Ennis, Jr. | |
| 3,745,731 A | * | 7/1973 | Simpson | E04B 1/35 52/236.6 |
| 4,302,915 A | * | 12/1981 | Stocks | E04H 6/10 52/175 |
| 5,280,689 A | * | 1/1994 | Mill | E04B 2/92 52/309.9 |
| 5,749,186 A | | 5/1998 | Kaufman et al. | |
| 7,779,586 B2 | | 8/2010 | Stewart et al. | |
| 8,011,147 B2 | * | 9/2011 | Hanlan | E04B 5/04 52/252 |
| 8,402,698 B1 | | 3/2013 | Wang | |

(Continued)

FOREIGN PATENT DOCUMENTS

| | | | | |
|---|---|---|---|---|
| DE | 10239624 B3 | * | 4/2004 | E04H 6/10 |
| GB | 560006 A | * | 3/1944 | E04B 1/20 |

(Continued)

*Primary Examiner* — Christine T Cajilig
(74) *Attorney, Agent, or Firm* — Renner, Otto, Boisselle & Sklar, LLP

(57) ABSTRACT

A multi-level parking garage constructed to be in close proximity to an adjacent building includes two or more levels above ground. Each of the two or more levels has a floor and a ceiling. The multi-level parking garage includes a load-bearing support structure for supporting the two or more levels and a plurality of fire-rated, non-load bearing exterior wall panels. Each of the exterior wall panels are independently and removably mounted to the support structure around at least a portion of a periphery of each of the two or more levels such that the plurality of exterior wall panels extend from the floor of each of the two or more levels to the ceiling of each of the two or more levels.

20 Claims, 7 Drawing Sheets

(56) References Cited

U.S. PATENT DOCUMENTS

| | | | | |
|---|---|---|---|---|
| 8,919,058 | B2 * | 12/2014 | Liberman | E04B 1/34384 52/283 |
| 10,683,665 | B2 | 6/2020 | LeBlang | |
| 10,760,270 | B2 | 9/2020 | Singleton et al. | |
| 2009/0311932 | A1 * | 12/2009 | Hughes | B32B 27/40 442/224 |
| 2011/0296769 | A1 * | 12/2011 | Collins | E04B 1/945 52/79.1 |
| 2014/0020316 | A1 * | 1/2014 | Proskurin | E04H 1/04 52/236.3 |
| 2020/0048904 | A1 | 2/2020 | Dombowsky et al. | |
| 2020/0056393 | A1 * | 2/2020 | McUtchen | E04C 5/08 |

FOREIGN PATENT DOCUMENTS

| | | | | |
|---|---|---|---|---|
| JP | 5947005 | B2 * | 7/2016 | E04H 6/10 |
| WO | 2007144635 | A2 | 12/2007 | |
| WO | 2019209107 | A1 | 10/2019 | |

* cited by examiner

MULTI-LEVEL PARKING GARAGE FOR WRAP STYLE BUILDING

TECHNICAL FIELD

The present invention relates generally to multi-level parking garages and more particularly to a multi-level parking garages for wrap style buildings.

BACKGROUND

Multi-level parking garages are typically constructed of solid concrete building blocks. For example, parking garages are often constructed with beams, columns and panels made of Portland concrete. Using, for example, pre-cast/pre-stressed or using cast-in-place/post-stressed building blocks, multi-level parking garages are constructed with solid concrete load-bearing beams, floor panels, and exterior wall panels, all configured to help carry the structural load of the parking garage. In multi-level parking garages constructed to be in close proximity to an adjacent building, such as a wrap-style residential or commercial building, the exterior wall panels that are constructed to be in close proximity to the adjacent building must meet fire regulations. To do so, each of these solid concrete exterior wall panels typically span multiple levels of the parking garage and can be around 8-9 inches thick, 13 feet wide, and 35-45 feet tall. These large panels can weigh up to 40,000-60,000 lbs, making them extremely expensive and laborious to build, transport and erect. While smaller exterior wall panels may be used in stand-alone, open concept parking garages, these smaller, partial exterior wall panels do not meet fire regulations and therefore cannot be used for parking garages constructed to be in close proximity to adjacent buildings.

In either stand-alone parking garages or garages constructed for wrap-style buildings, the solid concrete exterior wall panels are configured to be permanently mounted to the parking garage and pre- or post-stressed so that they are load-bearing and help carry the structural load of the multi-level parking garage. Removing or remodeling any of these solid concrete exterior wall panels, therefore, requires significant demolition and reconstruction.

SUMMARY

As ride-sharing programs become more common and popular as an alternative to driving personally owned cars in cities, the need for multi-level parking garages including a large number of parking spaces is being reduced. Accordingly, it is desirable to have the ability to remodel an existing multi-level parking garage for wrap style buildings, or at least one level or portion of such a multi-level parking garage, to be usable for another purpose, such as additional residential or commercial building space. As mentioned above, removing or remodeling the load-bearing solid concrete exterior wall panels typically used in multi-level parking garages is impractical, expensive and laborious, as it requires significant demolition and reconstruction. Additionally, as the conventional load-bearing solid concrete exterior wall panels help support a structural load of the parking garage and are configured to span multiple floors of the parking garage, there is no way to remodel or reconfigure only a single floor of the parking garage for an alternative use.

Therefore, a multi-level parking garage and method of constructing a multi-level parking garage configured to be in close proximity to an adjacent building are disclosed herein in which a plurality of lightweight, fire-rated, non-load bearing exterior wall panels are used instead of the large concrete, load-bearing exterior wall panels used in conventional multi-level parking garages for wrap style buildings. As used herein, the term "non-load bearing exterior wall panels" refers to the exterior wall panels in accordance with the present invention. The non-load bearing exterior wall panels are each independently and removably mounted to a load-bearing support structure of the multi-level parking garage around at least a portion of a periphery of each of two or more above ground levels. In this way, the non-load bearing exterior wall panels are easily removable on a panel-by-panel basis and/or on a level-by-level basis to convert or remodel at least a portion of the multi-level parking garage to be usable for a different purpose, such as for additional residential or commercial space. Additionally, each of the non-load bearing exterior wall panels are configured to extend from a floor of each level to a ceiling of each level to completely partition an interior of each level of the two or more levels from an exterior of the parking garage where the plurality of exterior wall panel is mounted. Each of the non-load bearing exterior wall panels are fire-rated and therefore meet fire regulations for parking garages constructed to be in close proximity to adjacent buildings.

According to an aspect of the invention, a multi-level parking garage constructed to be in close proximity to an adjacent building includes two or more levels above ground, each of the two or more levels having a floor and a ceiling. The multi-level parking garage also includes a load-bearing support structure for supporting the two or more levels and a plurality of fire-rated, non-load bearing exterior wall panels. The plurality of fire-rated, non-load bearing exterior wall panels are each independently and removably mounted to the support structure around at least a portion of a periphery of each of the two or more levels, such that the plurality of exterior wall panels extend from the floor of each of the two or more levels to the ceiling of each of the two or more levels.

According to an embodiment of one or more paragraphs of this summary, the plurality of exterior wall panels are selected from: structural insulated panels, solid lightweight concrete, T-Slab, and Hollowcore.

According to another embodiment of one or more paragraphs of this summary, the plurality of exterior wall panels have a fire rating in the range of 1 to 4 hours.

According to another embodiment of one or more paragraphs of this summary, the load-bearing support structure includes a plurality of vertically-extending support columns arranged in a spaced relationship and a plurality of horizontally-extending support beams extending between and supported by the vertically-extending support columns. The load-bearing support structure also includes a plurality of horizontally-extending floor panels supported by and extending between the plurality of horizontally-extending support beams to form one or more parking surfaces. The one or more parking surfaces respectively correspond to the one or more levels According to another embodiment of one or more paragraphs of this summary, the load-bearing support structure includes a plurality of structural wall support panels positioned along at least a portion of a periphery of the parking garage and a plurality of horizontally-extending floor panels supported by and extending between the plurality of structural wall support panels to form one or more parking surfaces, the one or more parking surfaces respectively corresponding to the one or more levels.

According to another embodiment of one or more paragraphs of this summary, the plurality of exterior wall panels are each independently and removably mounted to the plurality of horizontally-extending floor panels.

According to another embodiment of one or more paragraphs of this summary, a first end of each of the plurality of exterior wall panels is mounted to a top surface of a first horizontally-extending floor panel of the plurality of horizontally-extending floor panels and a second send of each of the plurality of exterior wall panels is mounted to a bottom surface of a second horizontally-extending floor panel of the plurality of horizontally-extending floor panels.

According to another embodiment of one or more paragraphs of this summary, the first end of each of the plurality of exterior wall panels includes a horizontally-extending slot on a bottom face of the first end of each of the plurality of exterior wall panels and the top surface of the first horizontally-extending floor panel of the plurality of horizontally-extending floor panels includes a horizontally extending projection corresponding to and aligned with the horizontally-extending slot such that the horizontally-extending projection is securely mated with the corresponding horizontally-extending slot.

According to another embodiment of one or more paragraphs of this summary, the horizontally-extending projection is secured to the top surface of the first horizontally-extending floor panel with concrete anchor screws.

According to another embodiment of one or more paragraphs of this summary, the first end of each of the plurality of exterior wall panels includes a stud having the horizontally-extending slot formed therein.

According to another embodiment of one or more paragraphs of this summary, the bottom surface of the second horizontally-extending floor panel of the plurality of horizontally-extending floor panels includes a plurality of brackets between which the second end of each of the plurality of exterior wall panels is captured.

According to another embodiment of one or more paragraphs of this summary, the plurality of brackets are secured to the bottom surface of the second horizontally-extending floor panel with concrete anchor screws.

According to another aspect of the invention, a method of constructing a multi-level parking garage to be in close proximity to an adjacent building includes a step of building a load-bearing support structure for supporting two or more levels of the multi-level parking garage, wherein the two or more levels each have a floor and a ceiling. The method also includes a step of independently and removably mounting a plurality of fire-rated, non-load bearing exterior wall panels to the support structure around at least a portion of a periphery of each of the two or more levels, such that the plurality of exterior wall panels extend from the floor of each of the two or more levels to the ceiling of each of the two or more levels.

According to an embodiment of one or more paragraphs of this summary, the step of building the load-bearing support structure may include erecting a plurality of vertically-extending support columns in a spaced relationship with each other and supporting a plurality of horizontally-extending support beams on the vertically-extending support columns such that the plurality of horizontally-extending support beams extend between the vertically-extending support columns. The step of building the load-bearing support structure may also include supporting a plurality of horizontally-extending floor panels on the plurality of horizontally-extending support beams such that the plurality of horizontally-extending floor panels extend between the horizontally-extending support beams to form one or more parking surfaces for vehicles to park on, the one or more parking surfaces respectively corresponding to the one or more levels.

According to another embodiment of one or more paragraphs of this summary, the step of building the load-bearing support structure may include erecting a plurality of structural wall support panels to be positioned along at least a portion of a periphery of the parking garage and supporting a plurality of horizontally-extending floor panels on the plurality of structural wall support panels such that the plurality of horizontally-extending floor panels extend between the structural wall support panels to form one or more parking surfaces for vehicles to park on, the one or more parking surfaces respectively corresponding to the one or more levels.

According to another embodiment of one or more paragraphs of this summary, the step of independently and removably mounting the plurality of exterior wall panels includes independently and removably securing the plurality of exterior wall panels to the plurality of horizontally-extending floor panels.

According to another embodiment of one or more paragraphs of this summary, securing the plurality of exterior wall panels to the plurality of horizontally-extending floor panels includes securing a first end of each of the plurality of exterior wall panels to a top surface of a first horizontally-extending floor panel of the plurality of horizontally-extending floor panels, and securing a second end of each of the plurality of exterior wall panels to a bottom surface of a second horizontally-extending floor panel of the plurality of horizontally-extending floor panels.

According to another embodiment of one or more paragraphs of this summary, securing the first end of each of the plurality of exterior wall panels to the top surface of the first horizontally-extending floor panel includes mating a vertically-extending projection of the top surface of the first horizontally-extending floor panel with a corresponding slot on a bottom face of the first end of each of the plurality of exterior wall panels.

According to another embodiment of one or more paragraphs of this summary, securing the second end of each of the plurality of exterior wall panels to the bottom surface of the second horizontally-extending floor panel includes capturing the second end of each of the plurality of exterior wall panels between a plurality of brackets secured to the bottom surface of the second horizontally-extending floor panel.

According to another aspect of the invention, a method of removing one or more exterior wall panels from the multi-level parking garage constructed by the method according to one or more paragraphs of this summary includes disconnecting the second bracket from the bottom surface of the second horizontally-extending floor panel so as to release the second end of the exterior wall panel from between the first bracket and the second bracket and removing the one or more exterior wall panel from the multi-level parking garage.

The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings show various aspects of the invention.

DETAILED DESCRIPTION

According to a general embodiment, a multi-level parking garage constructed to be in close proximity to an adjacent building includes a plurality of lightweight, fire-rated, non-load bearing exterior wall panels on any side, face, level or portion of the parking garage that is constructed to be in close proximity to the adjacent building. The term "close proximity," as used herein, refers to being withing, for example, 24 inches or less, down to a required minimum distance, of each other. For example, the multi-level parking garage may be built to be within a range of 1 to 24 inches, or 1 to 12 inches, from an adjacent building. The non-load bearing exterior wall panels are each independently and removably mounted to a load-bearing support structure of the multi-level parking garage at or around at least a portion of a periphery of each of two or more above ground levels. In this way, the non-load bearing exterior wall panels are easily removable on a panel-by-panel basis and/or on a level-by-level basis to convert or remodel at least a portion of the multi-level parking garage to be usable for a different purpose, such as for additional residential or commercial space of a residential or commercial wrap-style building. The term "two or more levels above ground" refers to any level that is at or above ground level. The term "non-load bearing" refers to the fact that the non-load bearing exterior wall panels are not configured to support any structural load of the parking garage, unlike the load-bearing support structure or the load-bearing exterior wall panels of the prior art. The term "fire-rated" refers to compliance with a respective local building code's general fire code. For example, the fire-rated panels may meet the fire code of ASTM E119. It is understood, however, that this example is non-limiting and that the term "fire-rated" may refer to compliance with any appropriate local building fire code under which the parking garage is constructed. Each of the fire-rated exterior wall panels are configured to extend from a floor of each level to a ceiling of each level to completely partition an interior of each level of the two or more levels from an exterior of the parking garage where the plurality of exterior wall panels are mounted. Each of the non-load bearing exterior wall panels are fire-rated and therefore meet fire regulations for parking garages constructed to be in close proximity to adjacent buildings.

Figure 1A:
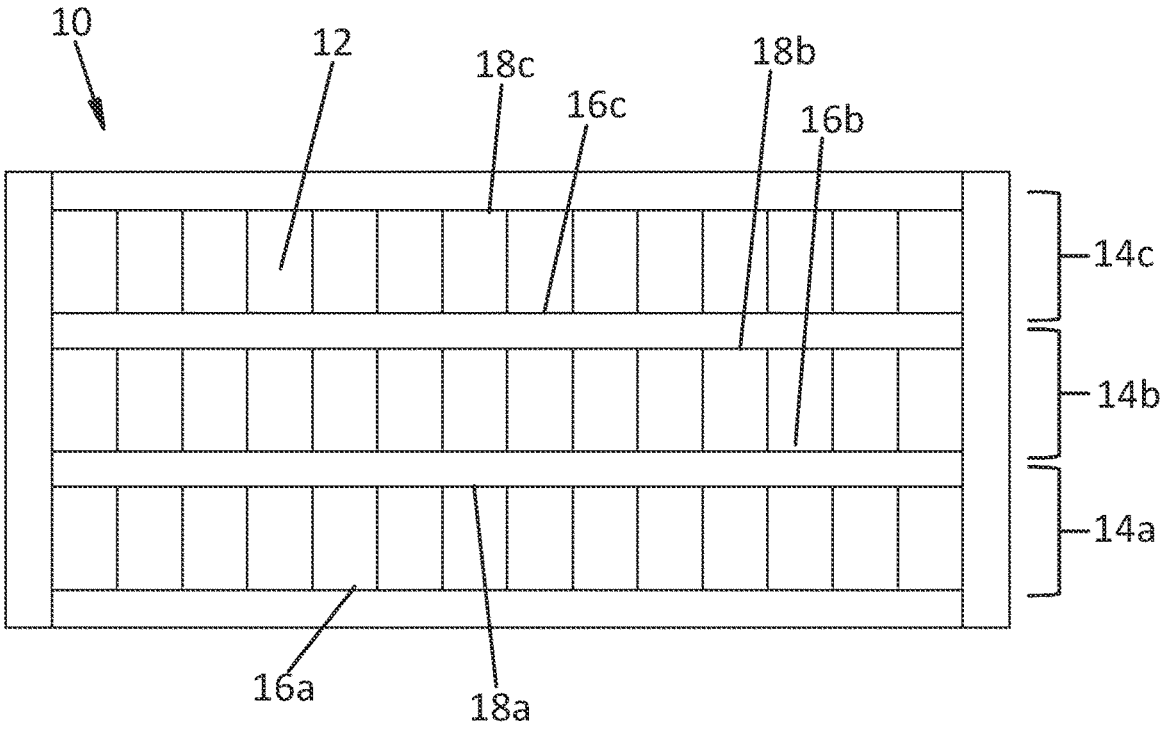
FIG. 1A is a schematic side elevation view of a multi-level parking garage.
Figure 1B:
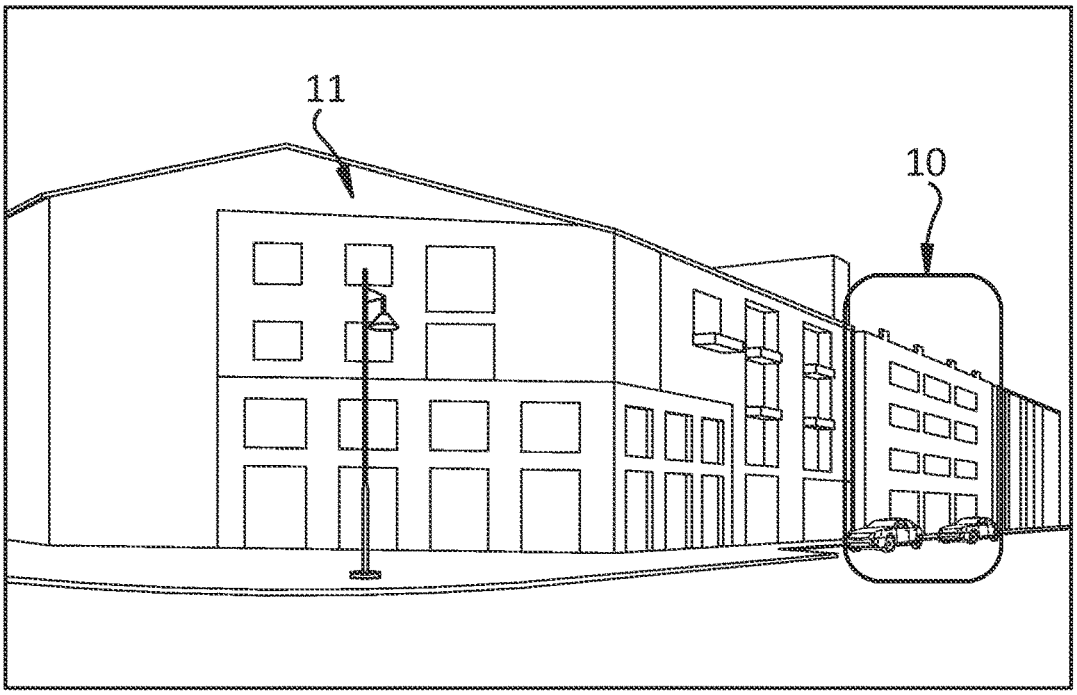
FIG. 1B is a picture of a wrap-style building constructed in close proximity to the multi-level parking garage of FIG. 1A.

With reference to FIG. 1A, an example multi-level parking garage 10 is depicted, specifically a face or side of the multi-level parking garage 10 constructed to be in close proximity to the adjacent residential or commercial building. For example, FIG. 1B depicts an example of an adjacent "wrap-style" residential building 11 that is constructed to "wrap" around all but one face or side of the parking garage 10. It is understood that the wrap-style residential building depicted in FIG. 1B is a non-limiting example and that the parking garage 10 according to the present disclosure may be constructed to be in close proximity to other types and styles of adjacent buildings.

The multi-level parking garage 10 has two or more above-ground levels 14*a-c*, each having a respective floor 16*a-c* and ceiling 18*a-c*. The multi-level parking garage 10 includes a plurality of lightweight, fire-rated, non-load bearing exterior wall panels 12 independently and removably mounted around at least a portion of a periphery of each of the two or more levels 14*a-c*. As depicted, the plurality of exterior wall panels 12 are configured to extend from a floor 16*a-c* of each level 14*a-b* to a respective ceiling 18*a-c* of each level 14*a-c* and are each fire-rated so as to comply with respective local building fire codes, as described above. For example, each of the plurality of exterior wall panels 12 may have a fire rating in the range of 1 to 4 hours or in the range of 2 to 3 hours. As described above, it is understood that the particular fire rating of the exterior wall panels 12 will depend upon the respective local building code under which the parking garage 10 is constructed. Local building codes are publicly available and readily ascertainable by the skilled artisan.

The exterior wall panels 12 may be made of, for example, solid concrete. The solid concrete exterior wall panels 12 may be of various types, such as siliceous concrete, carbonate concrete, sand-lightweight concrete, and/or lightweight concrete. The solid concrete exterior wall panels 12 may have varying thicknesses, based on the type of concrete that they are made of. For example, Table 1, reproduced below, depicts the various minimum thicknesses that each type of concrete must have to meet various fire-ratings under Building Code 2015 of Utah (sourced from: https://up.codes/s/calculated-fire-resistance#table_722.2.1.1). It will be understood that these examples are non-limiting and that other suitable types and thicknesses of solid concrete panels 12 may be applied to the concepts of the present disclosure.

TABLE 1

MINIMUM EQUIVALENT THICKNESS OF CAST-IN-PLACE OR PRECAST CONCRETE WALLS, LOAD-BEARING OR NONLOAD-BEARING

| | MINIMUM SLAB THICKNESS (inches) FOR FIRE-RESISTANCE RATING OF | | | | |
|---|---|---|---|---|---|
| CONCRETE TYPE | 1 hour | 1½ hours | 2 hours | 3 hours | 4 hours |
| Siliceous | 3.5 | 4.3 | 5.0 | 6.2 | 7.0 |
| Carbonate | 3.2 | 4.0 | 4.5 | 5.7 | 6.6 |
| Sand-lightweight | 2.7 | 3.3 | 3.8 | 4.6 | 5.4 |
| Lightweight | 2.5 | 3.1 | 3.5 | 4.4 | 5.1 |

The exterior wall panels 12 may alternatively be structural insulated panels such as carbon cast high performance insulated panels, T-slab, or Hollowcore. These alternative examples are also non-limiting and it is understood that any other suitable exterior wall panels 12 including the requisite fire rating may be applied to the concepts of the present disclosure.

Figure 2A:
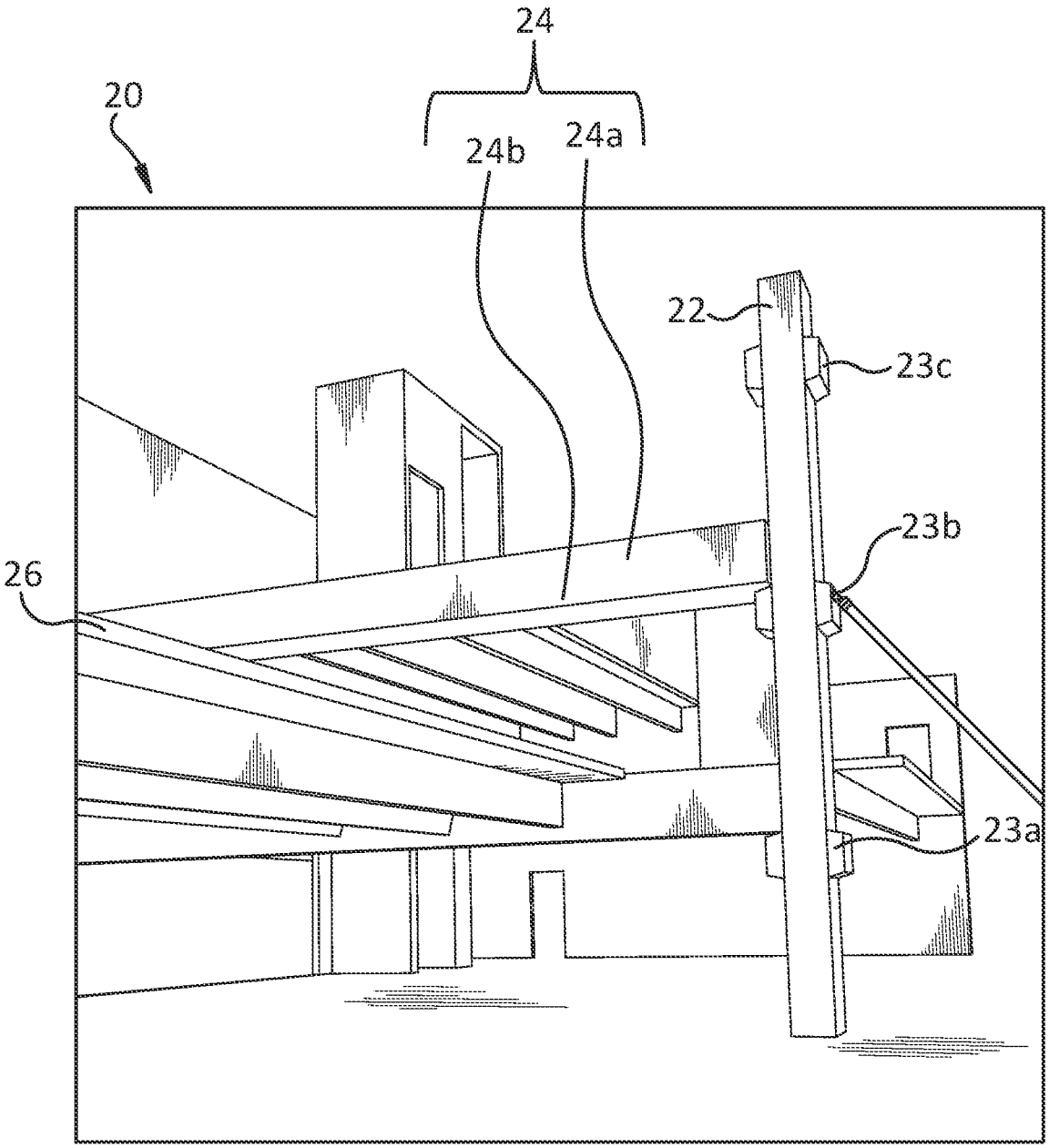
FIG. 2A is a perspective view of a load-bearing support structure for the multi-level parking garage depicted in FIG. 1.
Figure 2B:
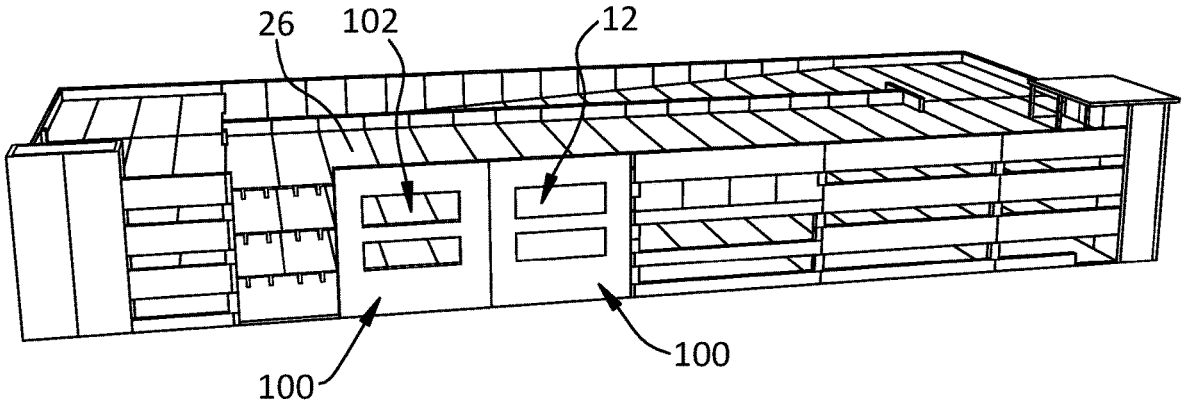
FIG. 2B is a perspective view of another load-bearing support structure for the multi-level parking garage.

The multi-level parking garage 10 includes a load-bearing support structure 20. The load-bearing support structure 20 may be of any suitable configuration. Two example embodiments of the load-bearing support structure 20 are depicted in FIGS. 2A-B and will be described herein. It is understood, however, that the example embodiments of the load-bearing support structure 20 described herein are provided as non-limiting examples and that other embodiments and configurations of the load-bearing support structure 20 may be applicable to this disclosure. In any embodiment, however, the plurality of exterior wall panels 12 are each independently and removably mounted to the load-bearing support structure 20 and do not, themselves, help carry any structural load of the multi-level parking garage.

For example, with reference to FIG. 2A, a first example load-bearing support structure 20 includes a plurality of vertically-extending support columns 22 arranged in a spaced relationship relative to each other. Each of the plurality of vertically-extending support columns 22 have horizontally-extending projections 23*a-c* vertically spaced apart thereon, each horizontally-extending projection 23*a-c* configured to help support one of the two or more levels 14*a-c* of the parking garage 10, respectively. The load-bearing support structure 20 additionally includes a plurality of horizontally-extending support beams 24 extending between and supported by the vertically-extending support columns 22, specifically by the horizontally-extending projections 23*a-c* on the vertically-extending support columns 22. The horizontally-extending support beams 24 may have, for example, an L or T-shape and therefore have a vertically extending portion 24*a* and at least one horizontally extending portion 24*b*.

The load-bearing support structure 20 also includes a plurality of horizontally-extending floor panels 26, each supported by and extending between the plurality of horizontally-extending support beams 24 to form respective parking surfaces (i.e., floors 16*a-c*) on each level 14*a-c* for vehicles to park on in the parking garage 10. The plurality of horizontally-extending floor panels 26 may have, for example, a double T-shape and have a main horizontally-extending portion and at least two vertically-extending portions extending from the main horizontally-extending portion on a bottom surface thereof. In the embodiment depicted in FIG. 2A, the at least two vertically-extending portions of the plurality of horizontally-extending floor panels 26 are supported on the at least one horizontally-extending portion 24*b* of the horizontally-extending support beams 24, while the main horizontally-extending portion of each of the plurality of horizontally-extending floor panels 26 is supported by the vertically extending portion 24*a* of the horizontally-extending support beam 24. The top surfaces of the plurality of horizontally-extending floor panels 26, therefore, form the respective parking surfaces (i.e., floors 16*a-c*) of each of the two or more levels 14*a-c*, and the bottom surfaces of the plurality of horizontally-extending floor panels 26 form the respective ceilings 18*a-c* of each of the two or more levels 14*a-c*.

A second example embodiment of the load-bearing support structure 20 is depicted in FIG. 2B. In this embodiment, the load bearing support structure includes structural wall support panels 100, instead of the vertically-extending support columns 22 and the horizontally-extending support beams 24, which not only provide load-bearing structural support but also may provide bracing against racking. The structural wall support panels 100 may be cast on site and raised into position along at least a portion of a periphery of the parking garage 10. The embodiment also includes the plurality of horizontally-extending floor panels 26 which each extend between and are supported by the structural wall support panels 100 to form the respective parking surfaces (i.e., floors 16*a-c*) of each level 14*a-c* for vehicles to park on in the parking garage 10. In the same way as with the first example embodiment of the load-bearing support structure 20, the top surfaces of the plurality of horizontally-extending floor panels 26, therefore, form the respective floors 16*a-c* of each of the two or more levels 14*a-c*, and the bottom surfaces of the plurality of horizontally-extending floor panels 26 form the respective ceilings 18*a-c* of each of the two or more levels 14*a-c*. The structural wall support panels 100 include windows or openings 102 extending from the respective floors 16*a-c* of each of the two or more levels 14*a-c* to the respective ceilings 18*a-c* of each of the two or more levels 14*a-c*.

In either embodiment of the load-bearing support structure 20, the plurality of exterior wall panels 12 are each independently and removably mounted to the horizontally-extending floor panels 26 of the support structure 20, at or around at least a portion of a periphery of each of the two or more levels 14*a-c*, respectively. Specifically, the plurality of exterior wall panels 12 are configured to be mounted such that they extend from the floor 16*a-c* of each of the two or more levels 14*a-c* to the respective ceiling 18*a-c* of each of the two or more levels 14*a-c*.

Figure 3:
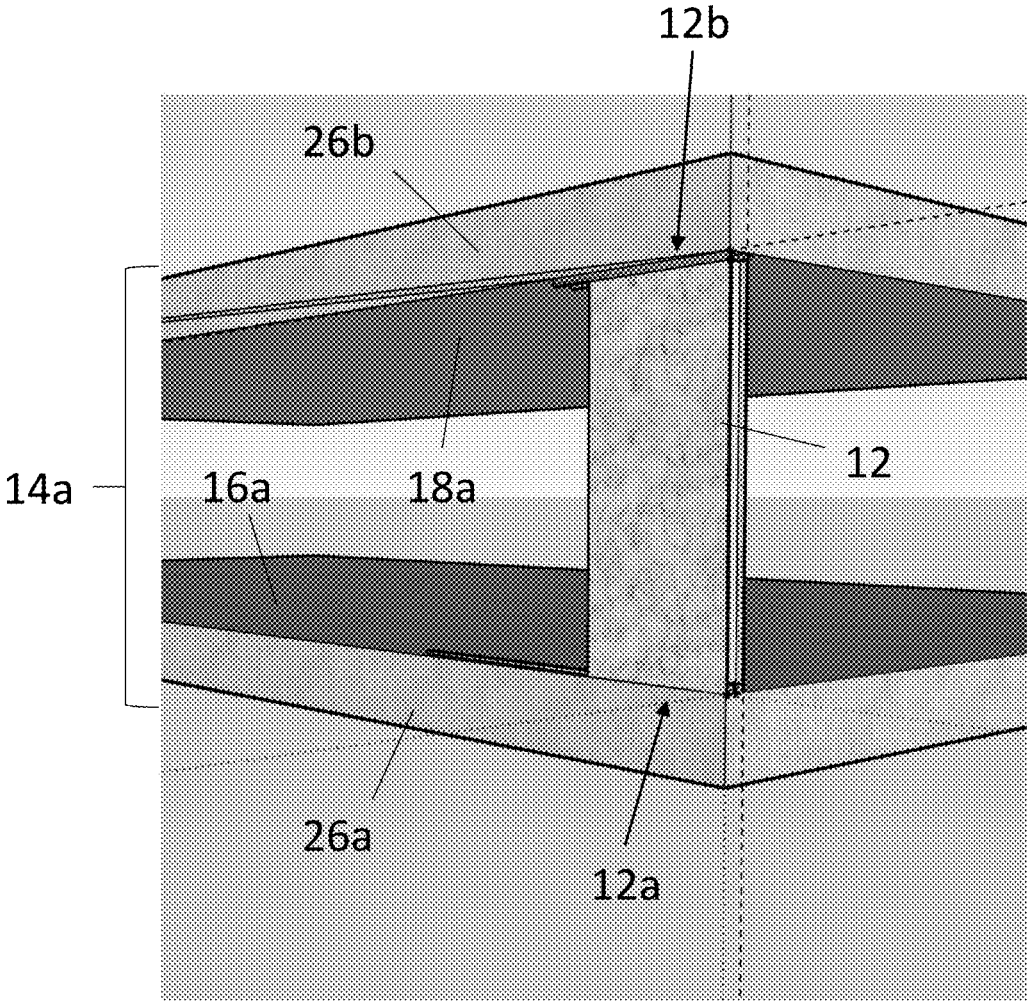
FIG. 3 is a perspective view of an exterior wall panel mounted to the load-bearing support structure of the multi-level parking garage.
Figure 4:
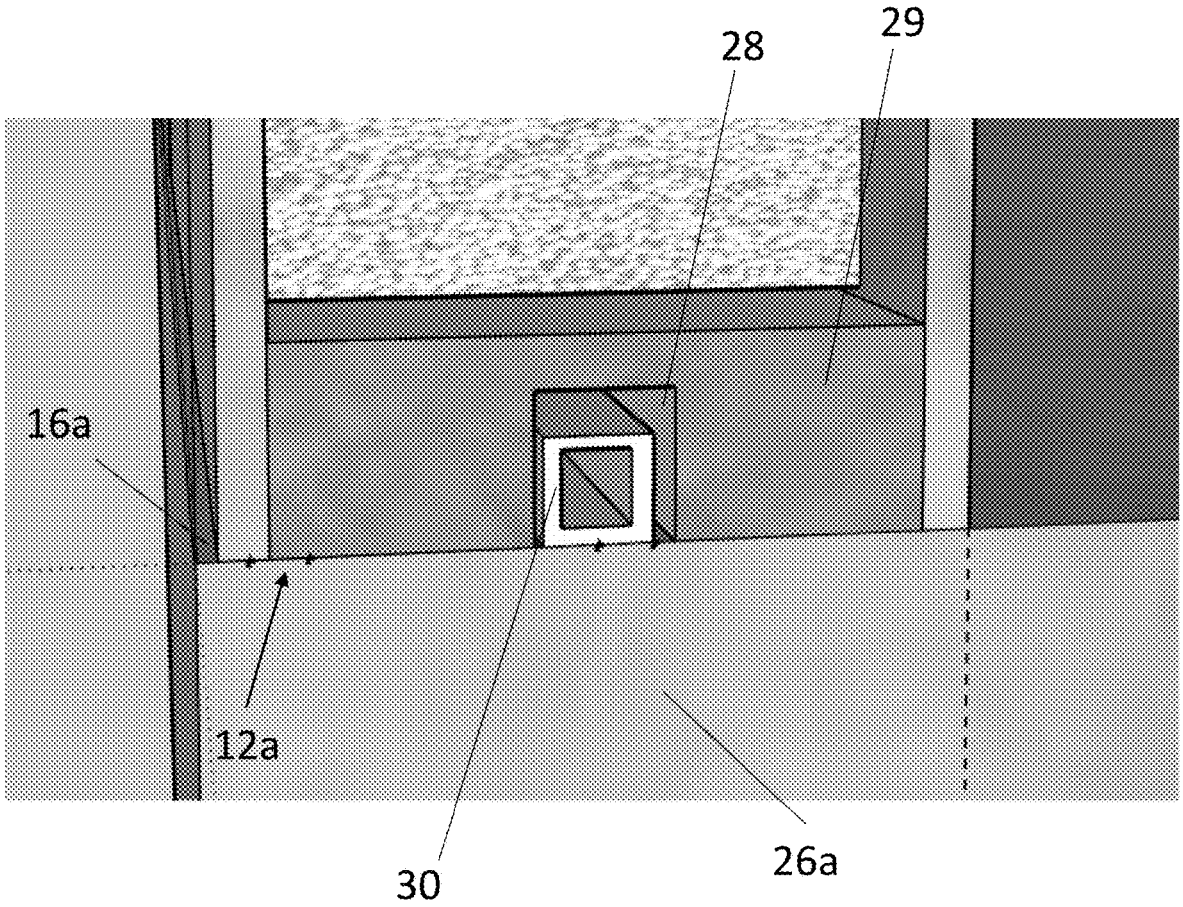
FIG. 4 is a cross-sectional perspective view of a first end of an exterior wall panel where mounted to the load-bearing support structure of the multi-level parking garage.
Figure 5:
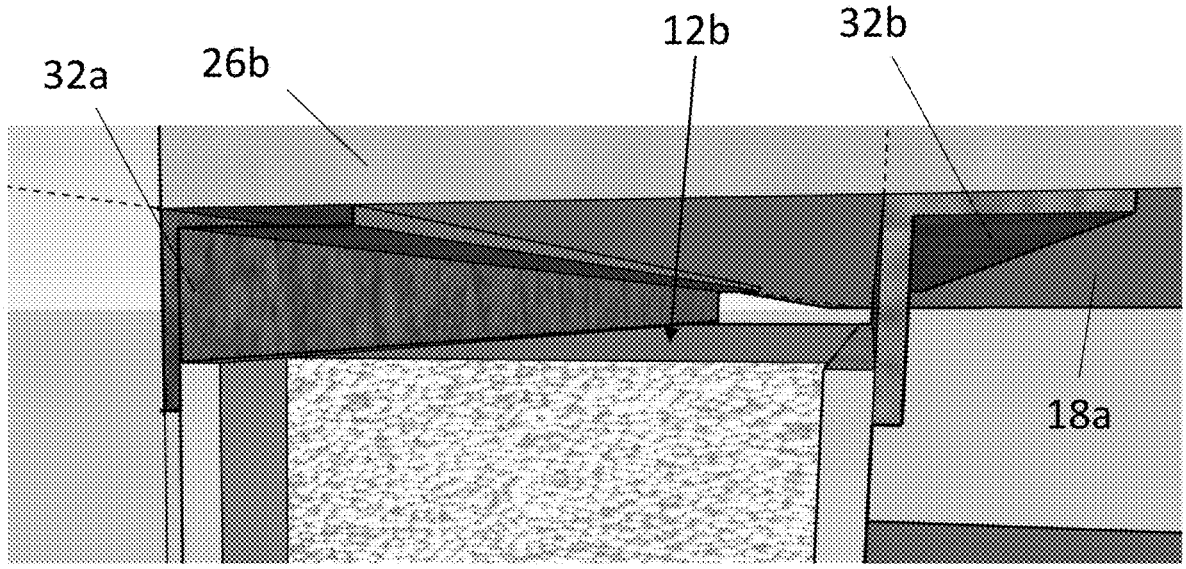
FIG. 5 is a cross-sectional perspective view of a second end of an exterior wall panel where mounted to the load-bearing support structure of the multi-level parking garage.

The plurality of exterior wall panels 12 may be mounted to the horizontally-extending floor panels 26 of the support structure 20 in any configuration and with any means suitable for independently and removably mounting the plurality of exterior wall panels 12. FIGS. 3-5 depict a non-limiting example configuration and means for independently and removably mounting each of the plurality of exterior wall panels 12 to the horizontally-extending floor panels 26 around at least a portion of a periphery of each of the two or more levels 14*a-c*. It is understood, however, that other suitable configurations may be applicable to the present disclosure.

With specific reference to FIG. 3, a single example non-load bearing exterior wall panel 12 is depicted as being mounted to the top surface of a first horizontally-extending floor panel 26*a* (i.e., floor 16*a* of a first level 14*a*) at a first end 12*a* and to a bottom surface of a second horizontally-extending floor panel 26*b* (i.e., ceiling 18*a* of the first level 14*a*) at a second end 12*b*. FIG. 4 depicts a closer cross-sectional perspective view of the first end 12*a* of the non-load bearing exterior wall panel 12 mounted to the top surface of the first horizontally-extending floor panel 26*a*. Specifically, as depicted in FIG. 4, the first end 12*a* of the exterior wall panel 12 may include a slot 28 or recess on a bottom face of the first end 12*a* which is configured to receive a corresponding vertically-extending projection 30 on the top surface of the first horizontally-extending floor panel 26*a* (i.e., floor 16*a*). The first end 12*a* of the exterior wall panel 12 may include a stud 29, for example a light metal gauge stud, having the slot 28 formed therein. Additionally, the vertically-extending projection 30 on the top surface of the first horizontally-extending floor panel 26*a* may be, for example, a metal tube secured to the top surface of the first horizontally-extending floor panel 26*a* along at least a portion of a periphery thereof with, for example, concrete anchor screws such as wedge anchors, expansion anchors, and/or lag shield anchors. Alternatively, the metal tube may be secured via traditional welding with the use of concrete embeds. It is understood that these examples of securing are non-limiting and that other types of securing may be applicable to the concepts of the present disclosure. The metal tube may be, for example a 1 inch hollow metal tube. When the first end 12*a* of the exterior wall panel 12 is mounted to the top surface of the first horizontally-extending floor panel 16*a*, the vertically-extending projection 30 is securely mated with the corresponding slot 28 of the first end 12*a* of the exterior wall panel 12.

FIG. 5 depicts a closer cross-sectional perspective view of the second end 12*b* of the non-load bearing exterior wall panel 12 mounted to the bottom surface of the second horizontally-extending floor panel 26*b*. Specifically, as depicted in FIG. 5, the second end 12*b* of the non-load bearing exterior wall panel 12 may be mounted to the bottom surface of the second horizontally-extending floor panel 26*b* with the use of, for example, a plurality of metal angle brackets 32*a* and 32*b*. Specifically, the second end 12*b* of the exterior wall panel 12 may be securely captured between a first bracket 32*a* and a second bracket 32*b*, which are both secured to the bottom surface of the second horizontally-extending floor panel 26 with, for example, at least one of the above-described types of securing. While FIG. 5 depicts some space between the second end 12*b* of the exterior wall panel 12 and the bottom surface of the second horizontally-extending floor panel 26*b* for purposes of illustrating the configuration of the brackets 32*a* and 32*b*, it is understood that the second end 12*b* of the exterior wall panel 12 will extend all the way up to the bottom surface of the second horizontally-extending floor panel 26*b*. In another embodiment, both the first end 12*a* and the second end 12*b* of the exterior wall panel 12 may be mounted to the respective surface of the first and second floor panels 26*a*, 26*b* with the use of a plurality of metal angle brackets, as described above.

In this manner, each of the plurality of exterior wall panels 12 in accordance with any embodiment of the present invention may be independently and removably mounted to the load-bearing support structure 20 of the multi-level parking garage 10 such that they do not help support any of the structural load of the parking garage 10 and such that they meet fire regulations for parking garages 10 constructed to be in close proximity to adjacent building structures, such as wrap-style buildings. Additionally, each of the plurality of exterior wall panels 12 may easily and inexpensively be removed and/or remodeled such that the multi-level parking garage 10, or any portion or floor 14*a-c* of the multi-level parking garage 10 may be remodeled and used for a different purpose, such as additional residential or commercial building space.

Figure 6:
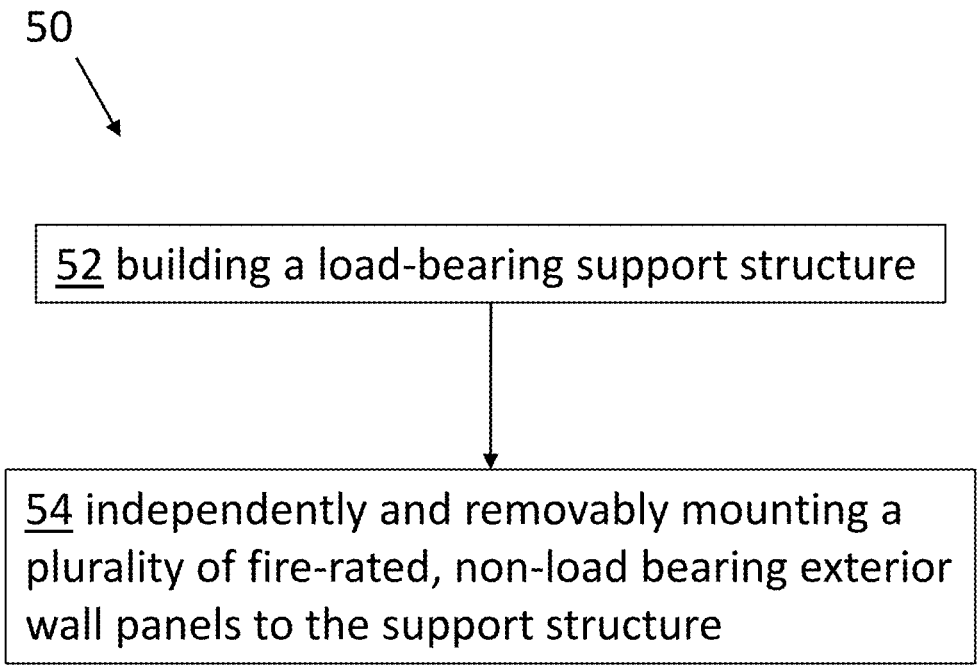
FIG. 6 is a flowchart of a method of constructing a multi-level parking garage.

With reference to FIG. 6, therefore, a method 50 of constructing a multi-level parking garage to be in close proximity to an adjacent building will be described. The multi-level parking garage may be that as previously described with reference to FIGS. 1-5. The method 50 therefore includes, at step 52, building a load-bearing support structure for supporting two or more levels of the multi-level parking garage. The two or more levels each have a floor and a ceiling. The method 50 then includes, at step 54, independently and removably mounting a plurality of fire-rated, non-load bearing exterior wall panels to the support structure around at least a portion of a periphery of each of the two or more levels, such that the plurality of exterior wall panels extend from the floor of each of the two or more levels to the ceiling of each of the two or more levels. The plurality of fire-rated, non-load bearing exterior wall panels may be that as previously described.

The step 52 of building the load-bearing support structure may include erecting a plurality of vertically-extending support columns in a spaced relationship with each other and supporting a plurality of horizontally-extending support beams on the vertically-extending support columns such that the plurality of horizontally-extending support beams extend between the vertically-extending support columns. Building the load-bearing support structure may then include supporting a plurality of horizontally-extending floor panels on the plurality of horizontally-extending support beams such that the plurality of horizontally-extending floor panels extend between the horizontally-extending support beams to form one or more parking surfaces for vehicles to park on. The one or more parking surfaces respectively correspond to the one or more levels. For example, the load-bearing support structure may be that as described with specific reference to FIG. 2A.

Alternatively, the step 52 of building the load-bearing support structure may include erecting a plurality of structural wall support panels such as those described with reference to FIG. 2B (structural wall support panels 100). Building the load-bearing support structure may then include supporting a plurality of horizontally extending floor panels on the plurality of structural wall support panels such that the plurality of horizontally-extending floor panels extend between the structural wall support panels to form one or more parking surfaces for vehicles to park on.

The step 54 of independently and removably mounting the plurality of exterior wall panels may include independently and removably securing the plurality of exterior wall panels to the plurality of horizontally-extending floor panels. Specifically, the method may include a step of securing a first end of each of the plurality of exterior wall panels to a top surface of a first or lower horizontally-extending floor panel of the plurality of horizontally-extending floor panels. The method 50 may also include securing a second end of each of the plurality of exterior wall panels to a bottom surface of a second or upper horizontally-extending floor panel of the plurality of horizontally-extending floor panels. In this way, each of the plurality of exterior wall panels are mounted such that they extend from the floor (i.e., top surface of the first or lower horizontally-extending floor panel) to the ceiling (i.e., bottom surface of the second or upper horizontally-extending floor panel) of each level.

The step of securing the first end of each of the plurality of exterior wall panels to the top surface of the first horizontally-extending floor panel may include mating a vertically-extending projection of the top surface of the first horizontally-extending floor panel with a corresponding slot on a bottom face of the first end of each of the plurality of exterior wall panels. The step of securing the second end of each of the plurality of exterior wall panels to the bottom surface of the second horizontally-extending floor panel may include capturing the second end of each of the plurality of exterior wall panels between a plurality of brackets secured to the bottom surface of the second horizontally-extending floor panel. Specifically, a first bracket may be secured to the bottom surface of the second horizontally-extending floor panel. Then, after the first end of an exterior wall panel is mounted to the top surface of the first horizontally-extending floor panel, the exterior wall panel may be tilted up such that it abuts the first bracket and is aligned in a substantially vertical position, extending from the top surface of the first horizontally-extending floor panel to the bottom surface of the second horizontally-extending floor panel. Then, a second bracket may be secured to the bottom surface of the second horizontally-extending floor panel so as to capture the second end of the exterior wall panel between the first bracket and the second bracket.

A method of removing one or more exterior wall panel from the multi-level parking garage constructed by method 50 may therefore include disconnecting the second bracket from the bottom surface of the second horizontally-extending floor panel so as to release the second end of the respective one or more exterior wall panel from between the first bracket and the second bracket. The respective one or more exterior wall panel will therefore be free to be removed from the multi-level parking garage. The first bracket and the vertically-extending projection of the top surface of the first horizontally-extending floor panel may also be removed such that the respective level of the parking garage may be remodeled for a different purpose.

Although the invention has been shown and described with respect to a certain preferred embodiment or embodiments, persons having ordinary skill in the art would recognize, based on the foregoing description, that alterations and modifications are within the scope of the foregoing description upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A multi-level parking garage in close proximity to an adjacent building, comprising:

a multi-level parking garage;

an adjacent budding adjacent to and at a distance away from the multi-level parking garage ranging from 1 inch to about 24 inches;

wherein the mufti-level parking garage comprises:

two or more levels above ground, each of the two or more levels having a floor and a ceiling;

a load-bearing support structure for supporting the two or more levels; and a plurality of fire-rated, non-load bearing exterior wall panels, each independently and removably mounted to the support structure around at least a portion of a periphery of each of the two or more levels, such that the plurality of exterior wall panels extend from the floor of each of the two or more levels to the ceiling of each of the two or more levels; the plurality of fire-rated, non-load bearing exterior wall panels providing fire protection between the multi-level parking garage and the adjacent building.

2. The multi-level parking garage according to claim 1, wherein the plurality of exterior wall panels are selected from: structural insulated panels, solid lightweight concrete, T-Slab, and Hollow Core.

3. The multi-level parking garage according to claim 1, wherein the plurality of exterior wall panels have a fire rating in the range of 1 to 4 hours.

4. The multi-level parking garage according to claim 1, wherein the load-bearing support structure includes:

a plurality of vertically-extending support columns arranged in a spaced relationship;

a plurality of horizontally-extending support beams extending between and supported by the vertically-extending support columns;

a plurality of horizontally-extending floor panels supported by and extending between the plurality of horizontally-extending support beams to form one or more parking surfaces, the one or more parking surfaces respectively corresponding to the one or more levels.

5. The multi-level parking garage according to claim 1, wherein the load-bearing support structure includes:

a plurality of structural wall support panels positioned along at least a portion of a periphery of the parking garage; and a plurality of horizontally-extending floor panels supported by and extending between the plurality of structural wall support panels to form one or more parking surfaces, the one or more parking surfaces respectively corresponding to the one or more levels.

6. The multi-level parking garage according to claim 4, wherein the plurality of exterior wall panels are each independently and removably mounted to the plurality of horizontally-extending floor panels.

7. The multi-level parking garage according to claim 6, wherein a first end of each of the plurality of exterior wall panels is mounted to a top surface of a first horizontally-extending floor panel of the plurality of horizontally-extending floor panels and a second end of each of the plurality of exterior wall panels is mounted to a bottom surface of a second horizontally-extending floor panel of the plurality of horizontally-extending floor panels.

8. The multi-level parking garage according to claim 7, wherein the first end of each of the plurality of exterior wall panels includes a horizontally-extending slot on a bottom face of the first end of each of the plurality of exterior wall panels and the top surface of the first horizontally-extending floor panel of the plurality of horizontally-extending floor panels includes a horizontally extending projection corresponding to and aligned with the horizontally-extending slot such that the horizontally-extending projection is securely mated with the corresponding horizontally-extending slot.

9. The mufti-level parking garage according to claim 7, wherein the first end of each of the plurality of exterior wall panels includes a stud having the horizontally-extending slot formed therein.

10. The multi-level parking garage according to claim 7, wherein the bottom surface of the second horizontally-extending floor panel of the plurality of horizontally-extending floor panels includes a plurality of brackets between which the second end of each of the plurality of exterior wall panels is captured.

11. A method of constructing a multi-level parking garage in close proximity to an adjacent building, the method comprising the steps of:

constructing a multi-level parking garage;

constructing an adjacent building adjacent to and at a distance away from the multi-level parking garage ranging from 1 inch to about 24 inches;

wherein constructing the multi-level parking garage comprises:

building a load-bearing support structure for supporting two or more levels of the mufti-level parking garage, wherein the two or more levels each have a floor and a ceiling;

independently and removably mounting a plurality of fire-rated, non-load bearing exterior wall panels to the support structure around at least a portion of a periphery of each of the two or more levels, such that the plurality of exterior wall panels extend from the floor of each of the two or more levels to the ceiling of each of the two or more levels; and providing fire protection between the multi-level parking garage and the adjacent building with the plurality of fire-rated, non-load bearing exterior wall panels.

12. The method according to claim 11, wherein the step of building the load-bearing support structure includes:

erecting a plurality of vertically-extending support columns in a spaced relationship with each other;

supporting a plurality of horizontally-extending support beams on the vertically-extending support columns such that the plurality of horizontally-extending support beams extend between the vertically-extending support columns; and supporting a plurality of horizontally-extending floor panels on the plurality of horizontally-extending support beams such that the plurality of horizontally-extending floor panels extend between the horizontally-extending support beams to form one or more parking surfaces for vehicles to park on, the one or more parking surfaces respectively corresponding to the one or more levels.

13. The method according to claim 11, wherein the step of building the load-bearing support structure includes:

erecting a plurality of structural wall support panels to be positioned along at least a portion of a periphery of the parking garage; and supporting a plurality of horizontally-extending floor panels on the plurality of structural wall support panels such that the plurality of horizontally-extending floor panels extend between the structural wall support panels to form one or more parking surfaces for vehicles to park on, the one or more parking surfaces respectively corresponding to the one or more levels.

14. The method according to claim 12, wherein the step of independently and removably mounting the plurality of exterior wall panels includes independently and removably securing the plurality of exterior wall panels to the plurality of horizontally-extending floor panels.

15. The method according to claim 14, wherein securing the plurality of exterior wall panels to the plurality of horizontally-extending floor panels includes securing a first end of each of the plurality of exterior wall panels to a top surface of a first horizontally-extending floor panel of the plurality of horizontally-extending floor panels, and securing a second end of each of the plurality of exterior wall panels to a bottom surface of a second horizontally-extending floor panel of the plurality of horizontally-extending floor panels.

16. The method according to claim 15, wherein securing the first end of each of the plurality of exterior wall panels to the top surface of the first horizontally-extending floor panel includes mating a vertically-extending projection of the top surface of the first horizontally-extending floor panel with a corresponding slot on a bottom face of the first end of each of the plurality of exterior wall panels.

17. The method according to claim 15, wherein securing the second end of each of the plurality of exterior wall panels to the bottom surface of the second horizontally-extending floor panel includes capturing the second end of each of the plurality of exterior wall panels between a plurality of brackets secured to the bottom surface of the second horizontally-extending floor panel.

18. A method of removing one or more exterior wall panel from the multi-level parking garage constructed by the method of claim 11, the method comprising:

disconnecting a second bracket from a bottom surface of a second horizontally-extending floor panel so as to release a second end of the exterior wall panel from between a first bracket and the second bracket; and removing the one or more exterior wall panel from the multi-level parking garage.

19. The multi-level parking garage according to claim 1, wherein the adjacent budding is adjacent to and at the distance away from at least two sides of the multi-level parking garage.

20. The multi-level parking garage according to claim 19, wherein the adjacent building is a "wrap-style" building that is adjacent to and at the distance away from at least three sides of the mufti-level parking garage.

* * * * *